United States Patent [19]

White

[11] 4,045,853

[45] Sept. 6, 1977

[54] METHOD OF MANUFACTURING FILTER DRUMS

[75] Inventor: Harold R. White, New Lenox, Ill.

[73] Assignee: Alar Engineering Corporation, Chicago, Ill.

[21] Appl. No.: 719,164

[22] Filed: Aug. 31, 1976

[51] Int. Cl.[2] ..... B23P 15/16

[52] U.S. Cl. ..... 29/163.5 F; 210/402

[58] Field of Search ..... 210/402, 403, 404, 406; 228/155, 158; 29/163.5 F, 163.5 R

[56] References Cited

U.S. PATENT DOCUMENTS

| | | | |
|---|---|---|---|
| 1,745,783 | 2/1930 | Clark | 228/158 |
| 1,795,634 | 3/1931 | Boykin | 210/402 |
| 1,882,178 | 10/1932 | Cumberland | 210/402 |
| 2,669,910 | 2/1954 | Trotman | 210/402 X |
| 3,013,666 | 12/1961 | Krynski | 210/402 X |
| 3,306,457 | 2/1967 | Putnam | 210/404 |
| 3,419,150 | 12/1968 | Davis | 210/404 X |
| 3,425,561 | 2/1969 | Steele et al. | 29/163.5 R |
| 3,504,802 | 4/1970 | Luthi | 210/404 |
| 3,747,770 | 6/1969 | Zentis | 210/402 |
| 3,876,548 | 4/1975 | Welles, Jr. | 210/402 |

*Primary Examiner*—Theodore A. Granger
*Attorney, Agent, or Firm*—Hill, Gross, Simpson, Van Santen, Steadman, Chiara & Simpson

[57] ABSTRACT

Filter drums of desired diameters and axial lengths are built up from cylindrical modules supported in end-to-end relation on a through axle. Each module has a cylindrical frame composed of end rings connected by and supporting a ring of circumferentially spaced longitudinal bars. A grid formed in the flat by welding spaced parallel transverse ribs to underlying spaced parallel longitudinal rods is rolled into a cylindrical shape and wrapped around bars of the module with the rods of the grid forming hoops which are welded to the bars. The through axle has end heads and intermediate spiders mounted thereon. The outboard rings of the modules forming the end sections of the drum are secured to the heads and the inboard rings of these end modules are secured to the end rings of the intermediate modules with spider legs on the axle secured to one ring of an adjacent pair of rings. One or more filter cloths are then wrapped around the ribs of the resulting drum to form the outer screen filtering periphery for the drum.

8 Claims, 6 Drawing Figures

Fig. 2
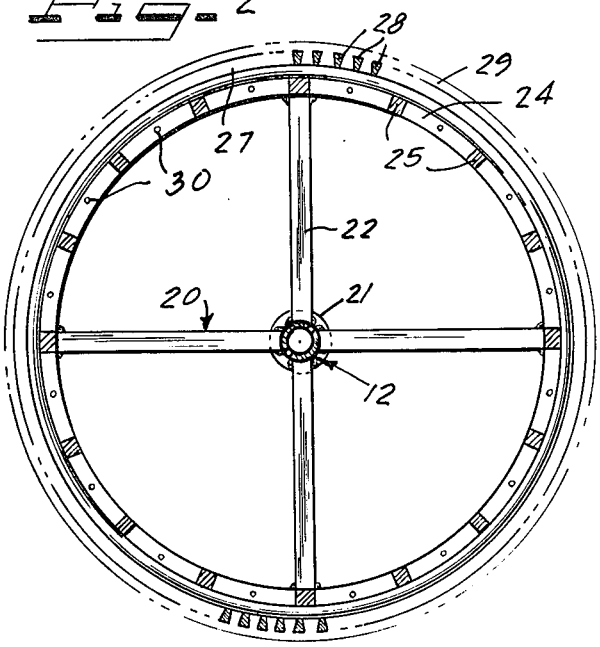
Fig. 4
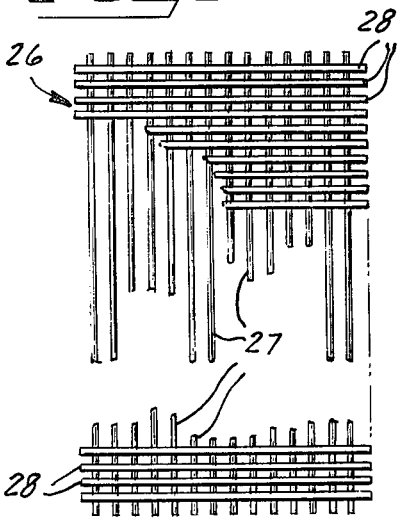
Fig. 6
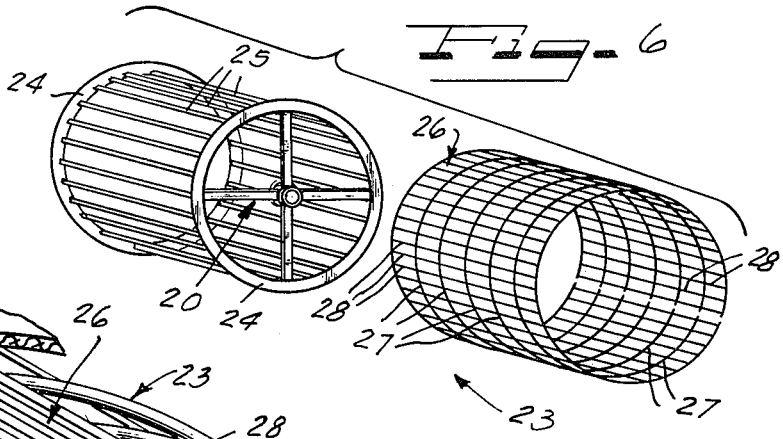
Fig. 3
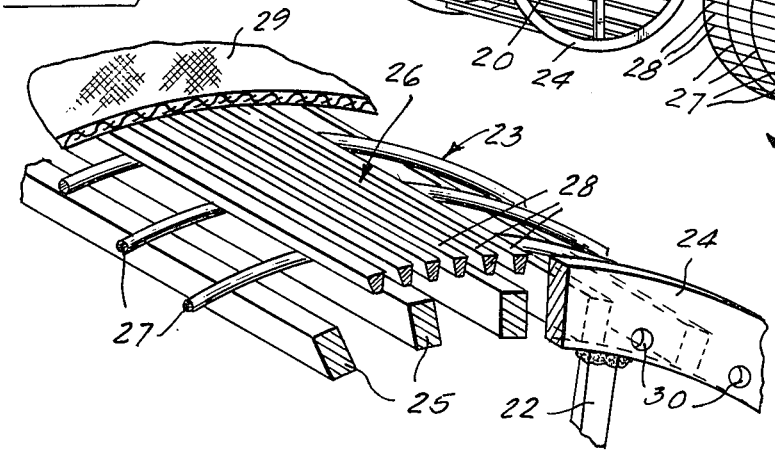
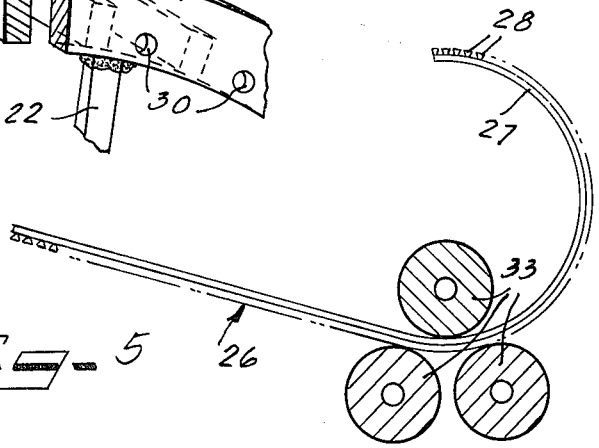
Fig. 5

METHOD OF MANUFACTURING FILTER DRUMS

FIELD OF THE INVENTION

This invention relates to the art of manufacturing filter drums for rotary filter apparatus and particularly deals with the construction of filter drums of any desired diameter and axial length from modules secured together in end-to-end relation and each composed of end rings, circumferentially spaced longitudinal bars mounted around the peripheries of the end rings to form a cylindrical frame and a grid composed of hoops and longitudinally extending ribs mounted around the bars.

PRIOR ART

Filter drums have heretofore had to be custom made by building a frame of the desired length and diameter and then surrounding the frame with supporting structure for a peripheral filter cloth or screen. This custom building of filter drums is expensive, time consuming and limited to diameters and lengths capable of being supported on an axle without deformation.

SUMMARY OF THIS INVENTION

This invention now provides a method of mass producing rotary filter drums of any desired size from modules that are easily and quickly manufactured and secured together in end-to-end relation around the drum axle. The modules are composed of end rings connected by a ring of circumferentially spaced longitudinally extending bars forming a rigid cylindrical frame. The span of the bars is limited to a length of which will not permit deflection of even relatively lightweight bars and generally the modules are only about three feet long and of any desired diameter. A grid formed in the flat from longitudinally extending spaced parallel rods and overlying transverse spaced parallel ribs bonded to the rods is rolled into cylindrical shape and wrapped around the bars of the module with the rods forming hoops that are welded to the frame bars. A through axle is inserted through a module and an end drum head on the axle is secured to the outboard end ring of the module. A spider has its legs welded to an end ring of a second module and the central boss of the spider is slipped over the axle to carry the second module so that its end ring will abut the end ring of the first module. The adjacent end rings are then bolted together. Additional modules and spiders are successively placed around the axle and bolted together to form the drum of the desired length. The opposite end head for the drum is mounted on the axle and bolted to the outboard ring of the last mounted module.

It will be understood that any number of modules can be used to build up the drum of the desired length and that the modules can be made of any desired diameter.

It is then an object of this invention to provide filter drums of any desired diameter and axial length from cylindrical modules secured together in end-to-end relation along the length of a through drum axle supporting the modules.

A further object of this invention is to provide a method of mass producing drums for rotary filter apparatus from prefabricated cylindrical modules.

Another object of the invention is to increase the available size ranges of rotary filter drums without adding excessive weight for structural strength.

A still further object of the invention is to provide a method of making an inexpensive lightweight rotary filter drum.

Other and further objects of this invention will be apparent to those skilled in this art from the following detailed description of the annexed sheets of drawings which by way of a preferred example illustrate one embodiment of the invention.

ON THE DRAWINGS

FIG. 2 is a transverse cross sectional view along the line II—II of FIG. 1.

FIG. 3 is a fragmentary isometric view showing the construction of a module of the filter drum.

FIG. 4 is a top plan view with parts broken away of a flat grid for the drum modules of this invention.

FIG. 5 is a somewhat diagrammatic end view showing the rolling of a grid into cylindrical shape according to this invention.

FIG. 6 is an exploded isometric view showing the components of a filter drum made by the method of this invention.

AS SHOWN ON THE DRAWINGS

Figure 1:
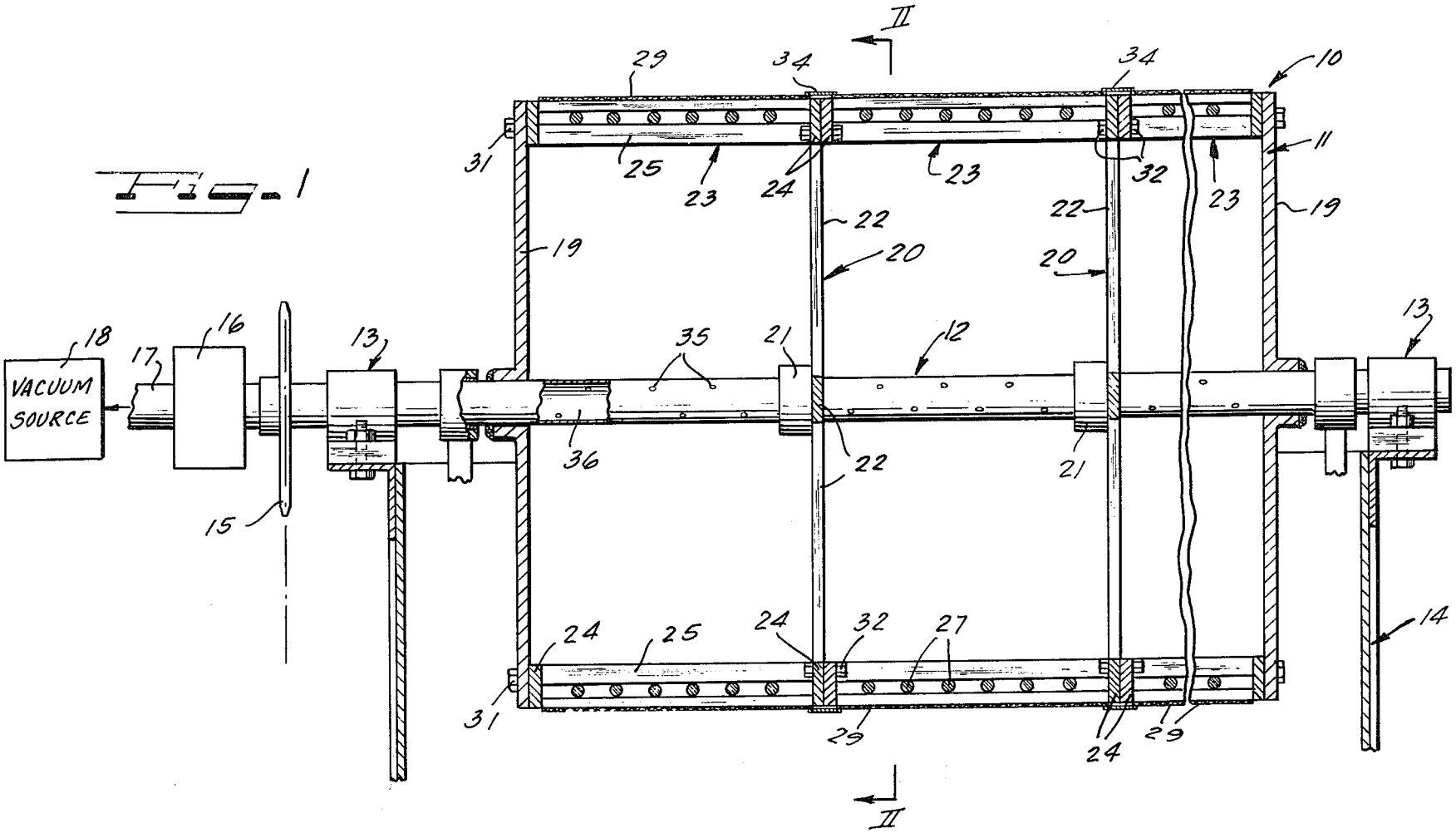
FIG. 1 is a fragmentary longitudinal cross sectional view, with parts in elevation of a rotary filter apparatus having a modular filter drum made by the method of this invention.

In FIG. 1, the reference numeral designates generally a rotary vacuum filter apparatus having a filter drum 11 mounted on a hollow through axle 12 which is rotatably supported in bearings 13 on a tank 14 through which the lower half of the drum rotates. The axle 12 is driven by a chain and sprocket drive 15 and is drained through a rotary coupling 16 into a vacuum conduit 17 exhausted by a suction pump, fan or the like 18.

The drum 11 has end heads or plates 19 mounted on and fixed to the axle 12 adjacent the bearings 13. Spiders 20 have hubs 21 mounted on and secured to the axle 12 at spaced intervals between the end heads 19. Legs 22 radiate from the hubs 21.

The drum periphery is built up from a plurality of modules 23 in end-to-end relation.

Each module 23 as shown in FIGS. 1, 2, 3 and 6, is composed of a pair of metal end rings 24 connected by and supporting a ring of circumferentially spaced parallel longitudinal metal bars 25. The ends of the bars 25 are welded to the inner opposing faces of the rings 24. The bars are rectangular in cross section with their radial inner ends substantially flush with the inner peripheries of the rings and with their radial outer ends terminating inwardly from the outer peripheries of the rings. The welded together rings 24 and bars 25 form a rigid cylindrical frame of a diameter controlled by the diameter of the rings and of a length controlled by the lengths of the bars.

The bars are surrounded by a grid 26 composed of circular hoop rods 27 wrapped around the bars in axially spaced relation and circumferentially spaced parallel longitudinally extending ribs 28 overlying the hoops 27 and welded thereto. These ribs 28 extend to the inner opposing faces of the end rings 24. As shown in FIG. 3, the ribs 28 have wide flat top ends and tapered sidewalls converging to narrower inner ends so that the slots or spaces between the ribs increase in width as they extend radially inward from the outer periphery of the cylindrical plane defined by the ribs. These slots are thus self-draining toward the interior of the drum. A screen cloth 29 is wrapped around the outer ends of the ribs to form the filter surface for the drum. This cloth 29 can span only a single module or a single cloth can be wrapped all of the modules 23.

The end rings 24 have bolt holes 30 at spaced intervals therearound. The outboard rings 24 of the end modules 23 receive bolts 31 through these bolt holes which mount the end modules on the drum heads 19. The bolts 31 draw the ring tightly against the inner faces of the drum head 19 at the peripheral margins of the head.

The inboard rings 24 of the end modules 23 and the adjacent end rings of the intermediate modules 23 receive bolts 32 through the holes thereof drawing the adjacent end rings 24 into tight face-to-face engagement and securing the modules in end-to-end relation.

The legs 22 of the spiders 20 are welded at their outer ends to the inner peripheries of one of the pair of abutting rings 24. For example, a spider 20 may be welded to the inboard ring of the outer modules 23 or to one or both rings of the intermediate modules, so that each bolted together module is supported radially at its ends from the axle 12, either by a drum head 19 or a spider 20.

As illustrated in FIG. 4, the grid 26 is formed in the flat from spaced parallel longitudinal rods 27 and overlying spaced parallel transverse bars 28 welded together to provide a unitary sheet.

The flat grid sheet 26 of FIG. 4 is rolled into cylindrical shape as shown in FIG. 5 by bending rollers 33 forming the longitudinal rods 27 into cylindrical hoops supporting a ring of the ribs 28.

The grid 26 can easily be made in any desired length and width to form the cylindrical screen supporting structure around the frame provided by the end rings 24 and bars 25. The hoops 27 of the cylindrical wrap around grid are welded to the outer faces of the bars 25 and the ends of the ribs 28 can be welded to the inner faces of the rings 24.

If the screens 29 are provided for each individual module 23, tapes 34, shown in FIG. 1, can be wrapped around the adjacent end edges of the screens 29 and around the abutted together rings 24 to prevent leakage between the ends of adjacent screens.

The axle 12 has drainage holes 35 in the drum and air and filtrate are drained through these holes and through the hollow interior of the axle which provides a drainage path 36 to the vacuum source 18. This vacuum source 18 creates a high velocity air flow through the passageway 36 pulling the filtrate through the holes 35 and also pulling air from the interior of the drum so that a slurry of material in the tank 14 will be filtered to form a film of solids around the screens 29 with the liquid filtrate being drained from the interior of the drum.

From the above descriptions, it will be therefore understood that this invention provides a method of making strong, lightweight, inexpensive filter drums built up from modules of any desired diameter and secured together in end-to-end relation to form a filtering periphery of any desired length. The modules are supported from the axle of the drum on spiders and end heads. The drum modules are easily formed from end rings and longitudinal bars forming cylindrical frames and grids composed of axially spaced circumferential hoops and circumferentially spaced transverse ribs. The ribs receive a filter screen therearound and drainage through the screen is unimpeded in the ample slot areas between the ribs which are unimpeded by the hoops and bars.

I claim as my invention:

1. The method of making a filter drum which comprises the steps of, making an elongate flat grid comprised of elongate spaced rods with overlying spaced ribs arranged transversely of said rods and secured thereto, rolling said grid into cylindrical form, forming a cylindrical frame constructed of open end rings and circumferentially spaced longitudinal bars connecting said end rings, wrapping said rolled grid around said cylindrical frame with the grid rods overlying the frame bars, joining opposed ends of the wrapped grid, securing a plurality of said grid wrapped cylindrical frames in end to end relation around a through axle by means of spiders on the axle secured to the frame end rings, mounting end heads on end portions of the through axle, and securing the end heads to the opposite ends of the assembled cylindrical frames.

2. The method of claim 1 including the added step of wrapping a filter cloth around the periphery of the grid on each frame.

3. The method of claim 1 including the step of wrapping a single filter cloth around the peripheries of all of the grids of the end to end secured together cylindrical frames.

4. The method of claim 1 including the step of providing a hollow through axle with holes to receive filtrate from the drum.

5. The method of claim 2 including the step of wrapping sealing tapes around adjacent edges of the filter cloths.

6. The method of claim 1 including the steps of bolting together the adjacent rings of the cylindrical frames in end to end relation and securing a spider to one of the two adjacent end rings.

7. The method of claim 1 including the step of positioning the longitudinal bars of the frames inwardly from the peripheries of the end rings sufficiently so that the periphery of the grid will lie substantially flush with the peripheries of the end rings.

8. The method of claim 7 including the step of securing the ends of the ribs of the grid to the portions of the end rings beyond the bars of the frames.

* * * * *